United States Patent [19]

Taylor et al.

[11] Patent Number: 4,490,651

[45] Date of Patent: Dec. 25, 1984

[54] LASER TRIGGERED HIGH VOLTAGE RAIL GAP SWITCH

[75] Inventors: Roderick S. Taylor, Ottawa; Kurt E. Leopold, Carp; A. John Alcock, Ottawa, all of Canada

[73] Assignee: Canadian Patents & Development Limited, Ottawa, Canada

[21] Appl. No.: 447,674

[22] Filed: Dec. 7, 1982

Related U.S. Application Data

[63] Continuation of Ser. No. 262,685, May 11, 1981, Pat. No. 4,401,920.

[30] Foreign Application Priority Data

May 23, 1980 [CA] Canada ..... 353041

[51] Int. Cl.[3] ..... H05G 37/02

[52] U.S. Cl. ..... 315/150; 313/570; 313/622; 250/423 P; 250/373; 315/156

[58] Field of Search ..... 313/570, 622; 250/423 P, 372, 373; 315/150, 156

[56] References Cited

U.S. PATENT DOCUMENTS

| | | | |
|---|---|---|---|
| 2,588,789 | 3/1952 | Zinn | 313/622 |
| 3,398,322 | 8/1968 | Guenther | 315/150 |
| 3,732,453 | 5/1973 | Johnson | 313/570 |
| 4,063,090 | 12/1977 | Bernhardt | 250/423 P |
| 4,401,920 | 8/1983 | Taylor et al. | 315/150 |

OTHER PUBLICATIONS

37 Laser-Triggered Switch Modification to VEBA" by Bettis et al., 1980 Fourteenth Pulse Power Modulator Symposium, Jun. 3-5, 1980.

*Primary Examiner*—Harold Dixon

*Attorney, Agent, or Firm*—Edward Rymek

[57] ABSTRACT

The laser-triggered high voltage rail gap switch includes two parallel electrodes in a high pressure environment of $SF_6$ and Ar. A pulsed UV laser directs a coherent beam parallel to the electrodes to initiate multichannel breakdown in the gap between the electrodes. This breakdown is enhanced by including an organic additive such as fluorobenzene or tri-n-propylamine in the gas mixture.

8 Claims, 4 Drawing Figures

LASER TRIGGERED HIGH VOLTAGE RAIL GAP SWITCH

This application is a continuation application of pending application, Ser. No. 262,685, filed May 11, 1981 in the names of R. S. Taylor, K. E. Leopold and A. J. Alcock now U.S. Pat. No. 4,401,920 issued Aug. 30, 1983.

BACKGROUND OF THE INVENTION

This invention is directed to devices for switching high voltages, and in particular, to rail gap switching devices triggered by a source of coherent UV radiation.

In order to switch high voltages from a low impedance pulse forming network into a rare gas halide laser discharge or other similar low impedance load, a low jitter, low inductance switching device is required. Present switching devices used in such applications include pressurized surface gaps, edge plane rail gaps with gas or liquid dielectric and electrically triggered rail gaps. However, for low jitter operation, both the surface gap and the edge plane rail gap require very rapid charging rates while the electrically triggered rail gap requires extremely fast high voltage trigger pulses.

UV-controlled switching devices are described in publication by Laird P. Bradley in the IEEE Journal of Quantum Electronics, September 1971, p. 464, and in the J. Appl. Phys., Vol. 43, No. 3, March 1972, p. 886–890. This type of device directs UV radiation between two discrete electrodes to control breakdown, however, this device is not satisfactory when multichannel, low inductance switching is required.

SUMMARY OF THE INVENTION

It is therefore an object of this invention to provide a device capable of controlled multichannel switching.

This and other objects are achieved in a high voltage rail gap switch for a pulse charged source, which includes a pair of parallel elongated electrodes spaced to have a gap between them. These rail gap electrodes are located in an enclosure containing a gas mixture of $SF_6$ and Ar above atmospheric pressure. A coherent UV source directs a pulsed beam through the gas mixture substantially parallel to the pair of electrodes for initiating multichannel breakdown of the gap between the electrodes.

One electrode of the pair, which is to be connected to a positive polarity with respect to the other electrode of the pair, has a cross-section exhibiting a tapered surface facing the other electrode. The one electrode may have a knife edge cross-section and the other electrode a circular cross-section. The other electrode includes a lead for connection to a negative pulse charged source.

In accordance with another aspect of this invention, the partial pressure of the Ar is 88–100% of the mixture. The UV radiation source may be a rare gas halide laser such as an ArF, KrF or XeCl laser, or an $N_2$ laser.

In accordance with yet another aspect of this invention, the gas mixture may include a small concentration of an organic additive which is preferably matched to the UV radiation wavelength for producing two-step photoionization for the production of a predetermined number of initial electrons in the gap. The additive may be fluorobenzene or trin-propylamine in a concentration of up to 0.01% of the gas mixture.

In accordance with a further aspect of this invention, the pulsed beam may be directed along the electrode having the tapered surface when the mixture dose not have an additive, or at some distance from this electrode when the mixture includes an additive.

Many other objects and aspects of the invention wll be clear from the detailed description of the drawings.

DETAILED DESCRIPTION OF THE EMBODIMENTS

Figure 1:
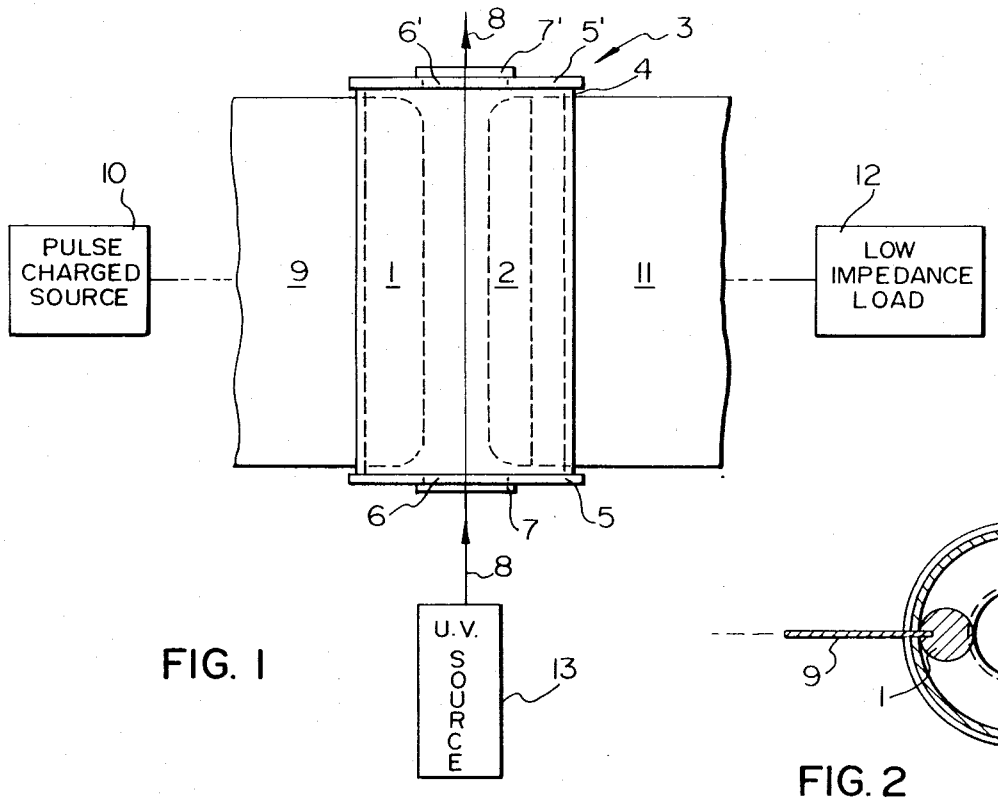
FIG. 1 illustrates a plan view of a rail gap switch in accordance with this invention.
Figure 2:
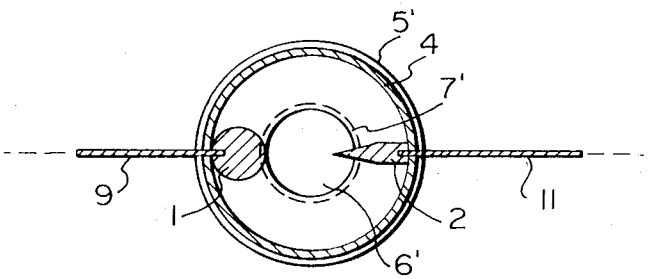
FIG. 2 illustrates a cross-sectional view of the switch shown in FIG. 1.

The controlled high voltage rail gap switch, as illustrated in FIGS. 1 and 2, consists of two elongated electrodes 1 and 2 which are mounted parallel to one another to establish a gap between them. The electrodes 1 and 2 are made of a highly conductive material, such as brass. Electrode 1 preferably has a generally circular cross-section to provide a curved surface facing the second electrode 2, which preferably has a knife-edge cross-section to provide a tapered edge facing the first electrode 1. The electrodes 1 and 2 are mounted in a non-conductive enclosure 3 which may consist of a plexiglass tube 4 having plexiglass end walls 5, 5'. The end walls 5, 5', each have an opening 6, 6', over which is mounted a quartz window 7,7', that it transparent to a pulsed beam 8 of UV radiation to be described later. Electrode 1 has a conductive sheet lead 9 for connection to a pulse charged source 10 which may include a transmission line, a capacitor bank or any other conventional pulsed source. Electrode 2 also as a conductive sheet lead 11 for connection to a low impedance load 12, such as a rare gas laser discharge load. The conductive sheet leads 9 and 11 may be made of copper. For satisfactory performance, the rail gap switch is connected such that electrode 1 is charged negatively, and the tapered edge electrode 2 is connected to positive ground through the load 12 such that it has a positive polarity with respect to electrode 1.

The enclosure 3 is filled with a gas mixture including $SF_6$ and Ar having a total pressure above one atmosphere. The gas mixture of $SF_6$ and Ar would preferably have Ar forming 88–100% of the mixture.

A coherent UV radiation source 13 provides the pulsed beam 8 through the quartz window 7 in one end 5 towards the quartz window 7' and the other end 5' of the enclosure 3. The UV radiation may be from a rare gas halide laser, such as ArF, KrF and XeCl lasers operating at wavelengths of 193 nm, 248 nm and 308 nm, respectively, or other UV lasers such as an $N_2$ laser. In addition, the pulsed beam in preferably directed along the knife edge of electrode 2 for optimum performance.

In operation, the incident laser beam 8 produces ionization in the region of electrode 2 which initiates breakdown in a controlled manner along the length of the electrodes. A high voltage rail gap switch of this type included two solid brass electrodes 1 and 2, which were 48 cm long and separated by a gap of approximately 3.7 cm. The electrode 1 was negatively charged from a pulse charged source 10 which includes a pulse forming network consisting of a distilled water dielectric transmission line energy storage element with a characteristic impedance $Z_o$ of approximately 2Ω. The pulse forming network was charged up to 140 kV in a charging time of approximately 800 ns. Electrode 2 was connected to a copper sulphate liquid resistor matched load of approximately 2Ω.

The gas mixture consisted of 10% $SF_6$ and 90% Ar at 3 atmospheres pressure. The pulsed laser beam 8 with a cross-section of $0.5\times2$ cm$^2$, was produced by a KrF laser having a wavelength of 2486 A, a pulse duration of 15 ns and a laser energy of 100 mJ.

Figure 3:
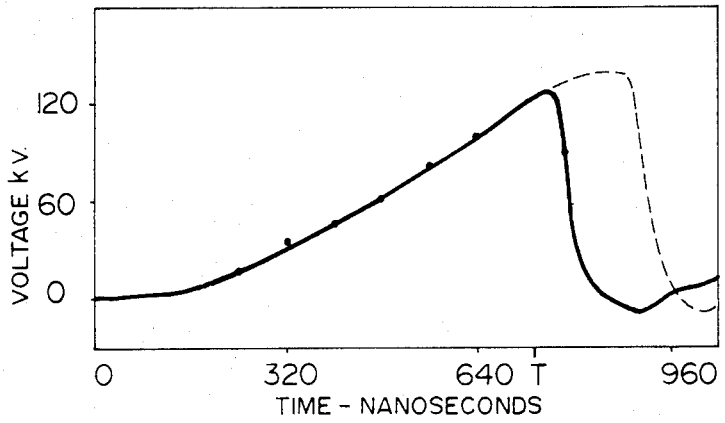
FIG. 3 shows the breakdown voltage of the rail gap switch.
Figure 4:
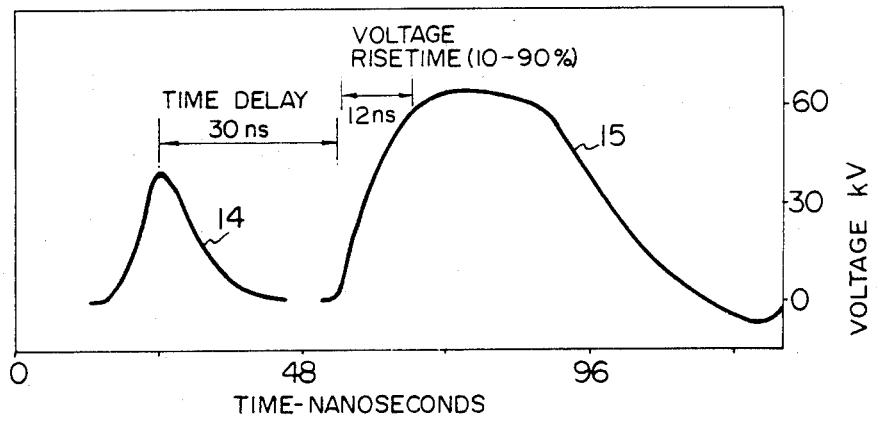
FIG. 4 shows the relationship between the triggering laser pulse and the switched voltage pulse.

In the absence of laser triggering, self-breakdown of the gap between electrodes 1 and 2 occurs in 1 or 2 channels with a jitter of approximately 75 ns. This breakdown is shown in FIG. 3 as the dashed curve. With the passage of UV radiation from the KrF laser through the rail gap at time T, and with the pulse changed source 10 at a voltage less than the self-breakdown voltage of approximately 140 kV, the breakdown, shown in the solid curve in FIG. 3, was reliably initiated. This breakdown was visually observed to occur with up to 50 channels per meter. The safety factor for reliable triggering, defined as the ratio of the self-breakdown voltage to the working voltage, can be s high as 1.7 but is typically 1.3. As shown in FIG. 4, the initiation of the voltage pulse 15 across the load 12 is delayed 30 ns from the peak of the laser pulse 14 and the voltage pulse 15 rise time is approximately 12 ns. The jitter between the optical pulse 14 and the voltage pulse 15 is $<5$ ns.

The addition of organic additives is small concentrations of up to 100 parts per million can enhance the initial ionization yield. Two-step photoionization is preferred in order to obtain a sufficient level of ionization without unduly attenuating the transmission of the radiation through the gas in the switch. However, the organic additive should be matched to the UV radiation wavelength in order to optimize two-step photoionization which would result in the production of a large number of initial electrons. For example, the use of fluorobenzene together with a KrF laser results in improved switch performance and allows the laser beam to be moved away from the knife-edge electrode 2.

In another example, a small concentration of tri-n-propylamine was preferred in a switch containing pure argon at 3 atmospheres since it permitted a 60 μJ $N_2$ laser to control a 40 kV hold-off-1.5 cm electrode gap.

Many modifications in the above described embodiments of the invention can be carried out without departing from the scope thereof, and therefore, the scope of the present invention is intended to be limited only by the appended claims.

We claim:

1. A high voltage rail gap switch for a pulse charged source comprising:

a pair of parallel elongated electrodes spaced to form an essentially constant width gap between the electrodes, the gap having a gap length along the electrodes substantially greater than the gap width;

enclosure means, the electrodes being located in the enclosure means and the enclosure means containing a gas mixture including $SF_6$ and Ar having a total presure above atmospheric pressure; and coherent UV radiation source means for directing a pulsed beam through the gas mixture in the gap along the gap length and substantially parallel to the pair of electrodes for initiating multiple simultaneous current sharing breakdowns along the length of the gap between the electrodes.

2. A high voltage rail gap switch as claimed in claim 1 wherein one electrode of the pair for connection to a positive polarity with respect to the other electrode of the pair, has a cross-section exhibiting a tapered surface facing the other electrode.

3. A high voltage rail gap switch as claimed in claim 2 wherein the other electrode includes a lead for connection to a negative pulse charged source.

4. A high voltage rail gap switch as claimed in claim 2 or 3 wherein the tapered surface of the one electrode of the pair has a knife-edged cross-section, and the other electrode of the pair has a substantially circular cross-section.

5. A high voltage rail gap switch as claimed in claim 1, 2 or 3 wherein the partial pressure of the Ar is greater than 88% of the mixture.

6. A high voltage rail gap switch as claimed in claim 2 or 3 wherein the pulsed beam is directed in the vicinity of the tapered surface of the one electrode.

7. A high voltage rail gap switch as claimed in claim 1 wherein the UV radiation source means includes a rare gas halide laser.

8. A high voltage rail gap switch as claimed in claim 7 wherein the laser is selected from the group consisting of an ArF, KrF or XeCl laser.

* * * * *